US005593153A

United States Patent [19]

Coombs

[11] Patent Number: 5,593,153

[45] Date of Patent: Jan. 14, 1997

[54] TRAY CONFIGURATION FOR SHEET RECEIVING APPARATUS

[75] Inventor: Peter M. Coombs, Tustin, Calif.

[73] Assignee: Gradco (Japan) Ltd., Tokyo, Japan

[21] Appl. No.: 546,848

[22] Filed: Oct. 23, 1995

[51] Int. Cl.[6] ..... B65H 39/10

[52] U.S. Cl. ..... 271/287; 271/293; 271/294; 271/209

[58] Field of Search ..... 271/207, 209, 271/278–279, 287, 292–294, 305

[56] References Cited

U.S. PATENT DOCUMENTS 4,361,319 11/1982 Ikeda et al. ..... 271/209

FOREIGN PATENT DOCUMENTS 236160 9/1989 Japan ..... 271/279

317960 12/1989 Japan ..... 271/292

143865 6/1991 Japan ..... 271/209

78002 3/1993 Japan ..... 271/207

*Primary Examiner*—Boris Milef

*Attorney, Agent, or Firm*—Newton H. Lee, Jr.

[57] ABSTRACT

A moving tray sorter has a set of trays configured to extend upwardly from a horizontal plane at the point of sheet entry and each tray has progressively from the sheet inlet end a back stop against which the trailing edges of sheet are aligned, a horizontally extended section and an upwardly inclined section of a substantial angle from the horizontal providing trays which are short, which occupy a relatively small area or footprint and which support sheets of relatively large size and overhang without droop of the sheets at the outer ends.

3 Claims, 4 Drawing Sheets

H
40
3
4B
40
L1

W
PS
3
H'
L1'
40
4D
PS

W
40

TRAY CONFIGURATION FOR SHEET RECEIVING APPARATUS

BACKGROUND OF THE INVENTION

Sorters of the general type here involved are shown, for example, in U.S. Pat. No. 5,393,042 granted Feb. 28, 1995, as well as in pending application, Ser. No. 334,907, filed Nov. 7, 1994 for Telescoping Registration For Sheet Receivers (now U.S. Pat. No. 5,531,437, Jul. 2, 1996) which is co-owned herewith and to which reference may be made for an understanding of the prior art.

Such sorters typically have a number of trays extending upwardly at an angle in the direction of sheet infeed from a horizontal plane, and the trays are progressively moved by appropriate cams upwardly and downwardly past the sheet entry location so as to receive sheets in collated or sorted relation or in groups or sets. Routinely the trays have had a length necessary to accommodate sheets of various sizes, say, ranging from normal letter size paper with a dimension of 8½×11" to larger sheets of paper on the order of 11×17". The length of the trays heretofore has been of such dimension as to accommodate the longest sheet dimension for which the sorter is designed in such a way that the surface area of the tray is sufficient to fully support a smaller size sheet and the lengthwise dimension of the tray is sufficiently long as to avoid drooping of the outer ends of the larger size sheets.

Such construction of the trays has typically required the use of trays of such a length that the overall footprint of a sorting machine embodying the trays is fairly large as a function of the tray length.

Also, the per tray cost of such sorter is a function of the size of the trays due to the cost of tray material.

The same problems apply, also, in the case of fixed bin sorters of the type wherein sheets of paper are fed from a sheet transport system by appropriate gating mechanisms, as illustrated in U.S. Pat. No. 4,591,914 granted Sep. 8, 1987, for example.

In either case, sorters of the types shown in the prior art referred to above have trays which extend upwardly at an angle from the point of horizontal entry of sheets of paper into the tray, and the trays have been of such length, as a matter of necessity, either to fully support the maximum size of sheets to be received by the trays or, at least sufficiently long as to prevent excessive overhang of a sheet or a set of sheets beyond the outer end of the tray to the extent that the sheet or set of sheets droops or hangs downwardly from the outer end of the tray, due to the inherent lack of beam strength in ordinary paper used in an office environment for printing by office copiers, printers and facsimile machines.

Particularly in the case of moving bin sorters of the types generally disclosed in U.S. Pat. No. 5,393,047, in which the trays are relatively close together at their outer ends while being opened at their inner ends for feeding sheets between the trays, avoidance of overhang of the sheets from the outer end of the tray above the sheet receiving tray and resultant drooping of the outer ends of such sheets is necessary. This is because the drooping of the outer ends of such sheets interferes with freedom of movement of sheets into the sheet receiving tray below. Therefore, trays have been relatively long, as mentioned above.

Also, in the case of sorters of the moving bin types, as referred to above, the trays have been disposed at a relatively low angle of inclination from horizontal, from the point of infeed of sheets, due to the need to eliminate, as much as possible, the tendency of succeeding sheets fed into a tray to displace proceeding sheets in a sheet feeding direction. This tendency results in faulty alignment of the trailing edges of the sheets against the ususal back stop, and such misalingment is unsatisfactory in the case of sorters which have facilities for automatic in bin or tray stapling.

The cause of the tendency of successive incoming sheets to displace preceding sheets is the speed of contact of the incoming sheets with the previous sheet combined with the interfacial drag friction of the two sheets resulting from moisture in the incoming sheet, static attraction or other factors.

SUMMARY OF THE INVENTION

The present invention addresses the problem of tray length and form as related to ability to receive incoming sheets, and, therefore, the ultimate space or footprint occupied by the sheet receiving apparatus as well as the per tray size in terms of material content and its impact on the overall cost of the sheet receiving apparatus.

More particularly, the present invention involves utilization of a plurality of factors in the formation of a sheet receiving tray for use in such moving tray or fixed bin sorters which is relatively short compared to the prior art trays, and, where the configuration of the tray causes a sheet deposited thereon to be provided with adequate beam strength as to resist drooping over the outer end of the tray.

These factors include, first of all, providing the beam strength which resists downward bending or drooping of a paper from a horizontally extended disposition past the end of a tray by inducing longitudinally extended transverse curvature in the sheet.

Another factor is the angle relative to horizontal at which the paper is disposed on the tray.

The present tray design involves a configuration which takes advantage of or recognizes the above factors in the structure of the tray, whereby the tray can be shorter than the prior trays, thereby causing a smaller footprint for the sheet receiving apparatus as a whole and utilizing a smaller quantity of material in the production of trays.

In a specific sense, the tray according to the present invention, has portions providing somewhat of a dihedral angle effectively causing a longitudinal bowing of so much of the sheet, depending upon its length, as extends outwardly beyond the tray.

In addition, the tray has a section extending substantially horizontally from the sheet inlet location a substantial distance to the juncture with an angularly upwardly extended section of the tray and at this junction, the sheet is caused to bend on a transverse line, thereby reducing, by the length of the horizontally extended section, the remaining portion of the sheet extending upwardly along the angularly extended portion of the tray subject to displacement in the feeding direction as a result of drag friction applied from an incoming sheet.

Thirdly, the portion of the tray which extends upwardly and outwardly at an angle from the horizontally extended section is disposed at a steep angle as compared with previous trays, as seen in U.S. Pat. Nos. 5,393,047 and 4,591,914 and includes the dihedral angled surfaces.

The invention will be best understood by reference to the accompanying drawings in conjunction with the following description of the preferred embodiment respectively illustrating and describing an illustrative embodiment.

BRIEF DESCRIPTION OF THE DRAWINGS

FIG. 3C is an enlarged view of the circled section of FIG. 3A.

DESCRIPTION OF THE PREFERRED EMBODIMENT

Figure 1:
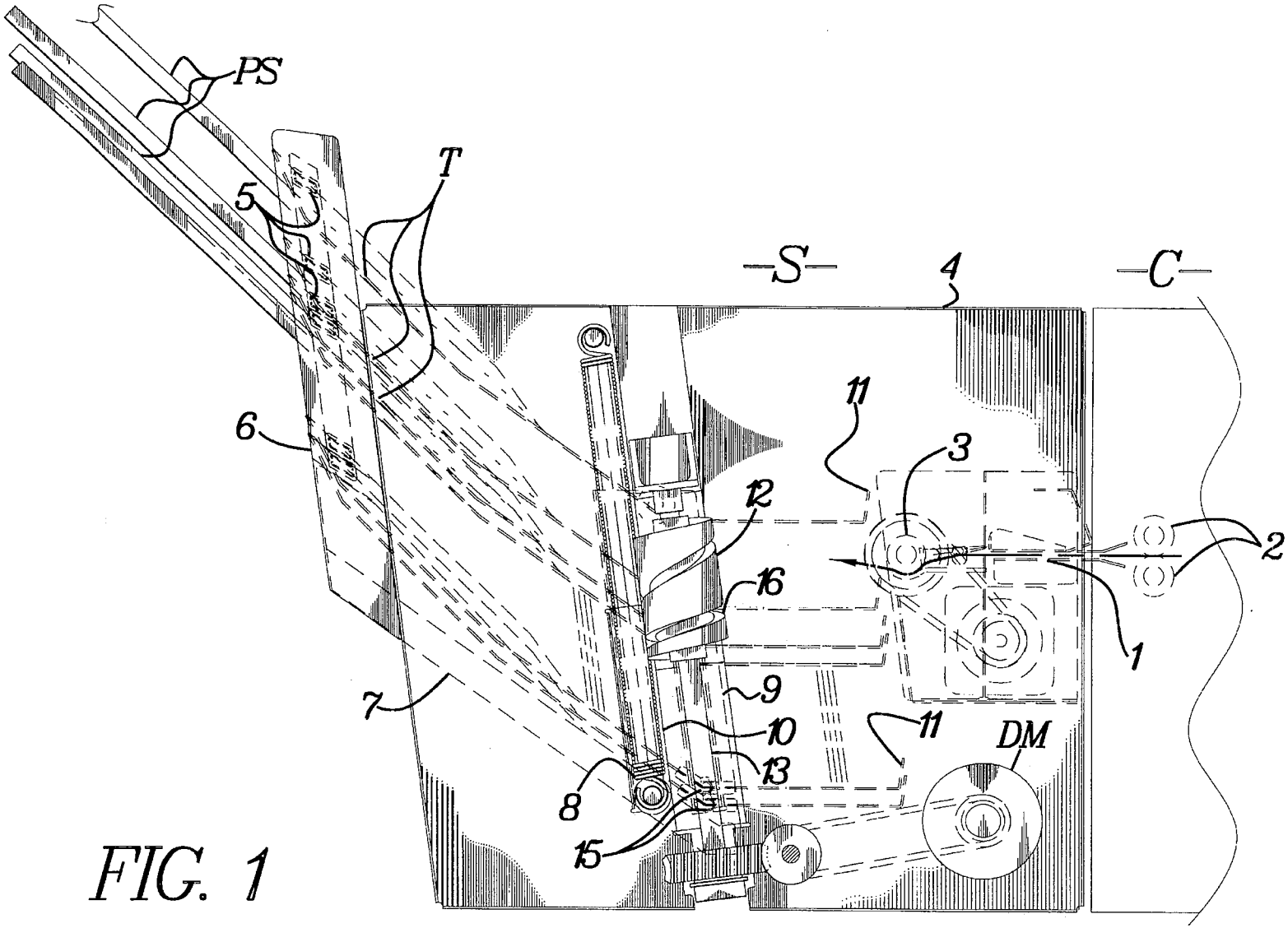
FIG. 1 is a side elevational view, with covers removed, to show the interior construction of an exemplary sheet receiving machine embodying trays made in accordance with the invention.
Figure 2:
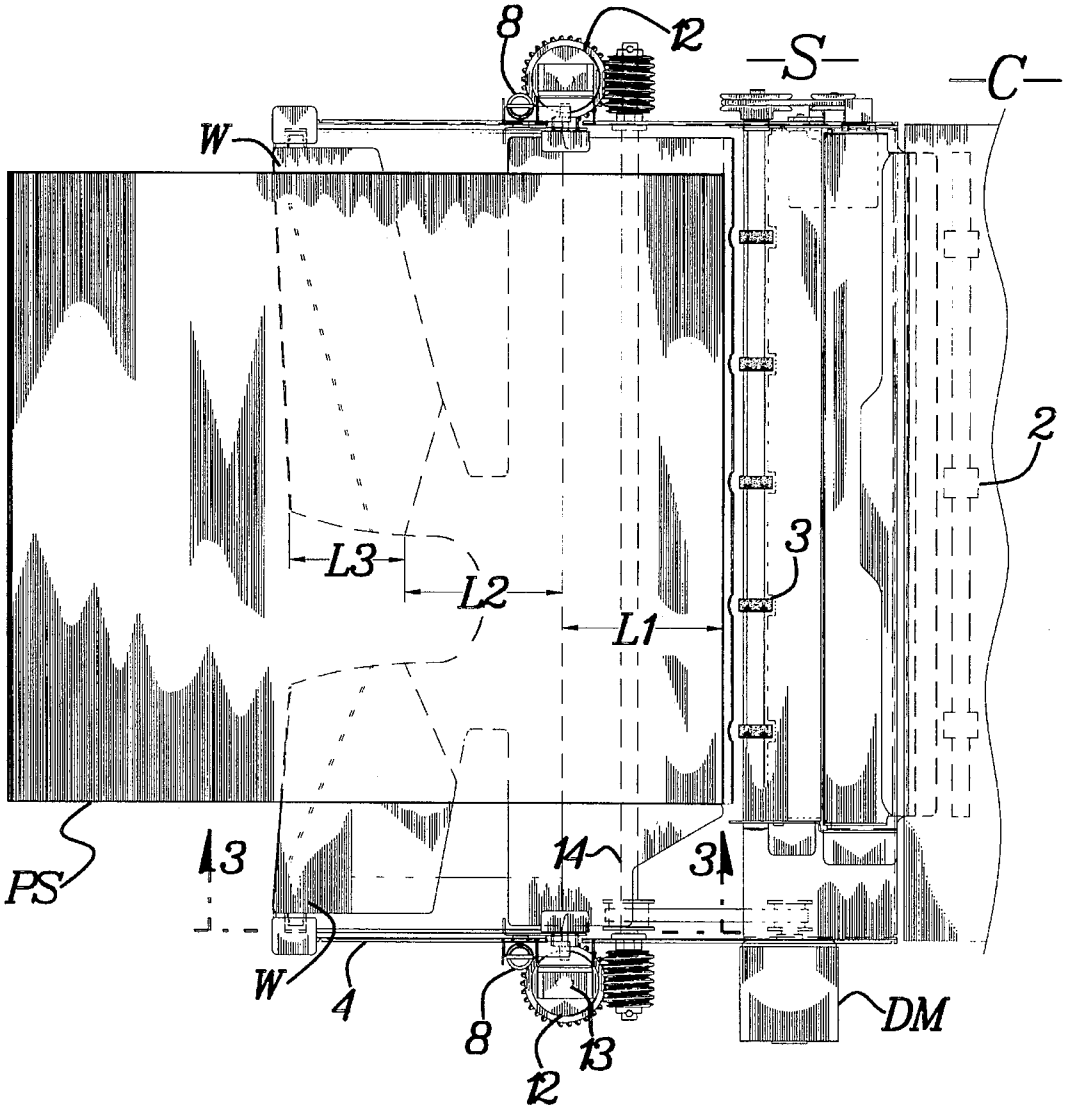
FIG. 2 is a top plan view with covers removed.

As seen in the drawings, referring first to FIG. 1, a sorting machine S is positioned adjacent to a copying or printing machine C. Sheets of paper are fed through a feed path 1 from outlet feed rolls 2 of the machine C to infeed roll means 3 of the sorter for feeding sets of printed sheets PS into trays T.

A set of trays T are extended horizontally, but at an incline from the sorter housing 4 and are supported at their outer ends in vertically extended side supports 5. The outer end 6 of the lower most tray T rests on a bottom tray support 7. Tray support 7 is adapted to move vertically and is biased upwardly at its inner end by a coiled spring 8 connected at its upper end to the housing and at its lower end to a lift frame 9 adapted to move vertically along guide edge 10, as the inner ends 11 of the trays are caused to move vertically.

Vertical movements of the inner tray ends 11 are caused in response to rotation of a pair of spiral cams 12 at opposite sides of the tray rotatable with shafts 13 adapted to be driven in unison by a reversible drive motor DM and a transversely extended drive shaft 14. Each tray end 11 has a pair of trunnions 15 for engagement in a spiral cam track 16 for opposite movement of the tray ends 11 responsive to opposite rotation of cams 12.

Figures 3A, 3B:
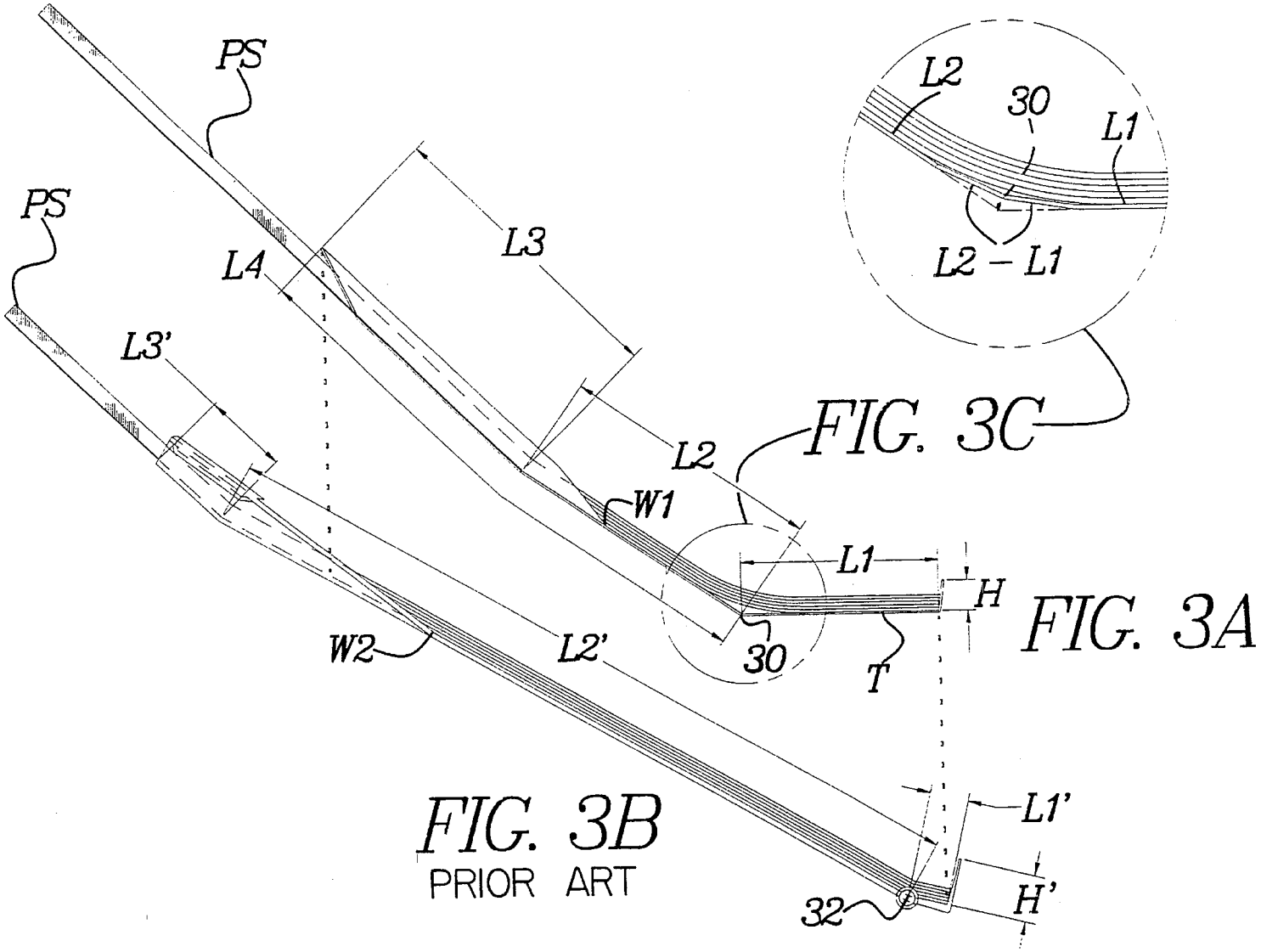
FIG. 3B PRIOR ART
FIG. 3A is side elevation viewed on the line 3—3 of FIG. 2, of a tray embodying the invention.
FIG. 3B is a view like FIG. 3A, but showing a tray constructed in accordance with the prior art.

Referring to FIGS. 3A and 3B, the present tray construction is illustrated and compared with the tray construction in the aforementioned U.S. Pat. No. 5,393,042.

As seen in FIG. 3A, the tray is formed with three paper receiving sections L1, L2 and L3. The total horizontal extension of the tray shown in FIG. 3A from an upwardly extending back stop H is determined by the relative lengths of sections L1, L2 and L3 and the angle of sections L2 and L3 relative to a horizontal plane. Sheets fed into the tray are caused to be moved downwardly against the back stop H as a result of the angle of inclination of the sections L2 and L3 from the substantially horizontal plane of section L1, as will be later described.

In FIG. 3A the tray section L2 extends upwardly at an angle of approximately 35 degrees from its juncture with section L1 at 30 while tray section L3 extends further longitudinally and further upwardly at an angle of approximately 45 degrees from the horizontal plane extending from section L1.

In the form shown, the tray section L1 equals approximately 29% of the total length of the tray, while tray sections L2 and L3 respectively constitute 38% and 33% of the total tray length, respectively. In order to assist in the bending of the sheets PS at the juncture L1 and L2, the junction may be formed by either a curvature or by embodying one or more short straight sections, L1 and L2, as seen in FIG. 3C.

Referring to the prior art of FIG. 3B, it will be seen that the tray section L1' is of very short horizontal extent to the juncture 32. The remaining section L2' of the tray extends further horizontally and upwardly. In this prior art tray, L1'=3%, L2'=87%, and L3'=10%, respectively of the total length.

The angle of the upward extension of the tray of FIG. 3B from a horizontal plane form the junction 32 with a short tray section L1'. L1', in this form, also has a slight angle of about 13 degrees, but for practical purposes may be deemed horizontal.

A comparison of FIGS. 3A and 3B shows that the tray 3A from the upper extremity of the tray section L3 in a left hand direction from the left hand extremity of the tray section L1 has a combined length L4 which is of significantly less horizontal extension than the combination of the total horizontal extension of the prior art tray of FIG. 3B from the upper end of the tray section L3' to the left hand end of the tray section L1'. Therefore, a set of trays of FIG. 3A employed in the sorter S, occupy a horizontal footprint which is significantly less than the footprint of the prior art sorter tray of FIG. 3B and the quantity of material employed in each tray is significantly reduced as a result of the modified construction of FIG. 3A.

It is also important to note that the printed sheet set PS in the tray of FIG. 3A extends upwardly beyond the upper outer end of the tray without hanging downwardly, due to the fact that the configuration of the tray of FIG. 3A takes advantage of its ability to utilize various factors which affect the resistance of the sheets to bending or the beam strength of the printed sheets as they rest in the tray of FIG. 3A, with the lower ends of the sheets abutting against the backstop H and the upper ends of the sheets projecting substantially beyond the uppermost tray section L3.

One factor which has the effect of reducing bending or enhancing beam strength of printed sheets is the fact that the sheets of paper are caused to bend at least at the point 30 in a direction transversely of the set of paper sheets so that the apparent length of the sheets PS from the outer and upper extremity to the point of abutment with the backstop H is reduced by the length of the tray section L1 at the point 30 at which the sheets are caused to bend, so that the reduction in the apparent length of the sheet results in a reduction in the tendency of the sheet to bend in a transverse direction or hang down at the outer upper end of the apparently shorter sheet. Another factor is that of the angle at which printed sheets extend in an upward direction from the horizontal is increased significantly in the present tray from the angle of sheets supplied to the upper portion of the prior art tray of FIG. 3B, so that the overhanging weight or cantilever effect on the paper sheets is reduced, notwithstanding the fact that the tray is significantly shorter in FIG. 3A as compared with FIG. 3B.

In order to impart added beam strength to the paper sheets PS extending beyond the outer ends of the trays T, the trays are provided with wing sections W which extend somewhat upwardly and outwardly from or somewhat to one side of the longitudinal center of the tray on what may be called a dihedral angle and commencing in the region of the tray section L2 at W1 and extending outwardly and upwardly along the sides of the tray to or approximately to the outer extremely of the tray. The provision of such wings W2 on the trays, per se, as seen in FIG. 3B is customary, but in the present tray construction, the effect of the wings in the provision of added beam strength is accentuated by reason of the relatively steep angle from the horizontal at which the tray of the present invention extends. This is attributable to the fact that the steeper the incline the shorter the horizontal projection of the paper sheets PS beyond the outer extremity of the tray, the greater the effect of the beam strength on the paper sheets.

As previously indicated, trays according to the prior art have, of necessity, been sufficiently long as to resist drooping of the outer ends of the paper sheets from the outer ends of the trays into the paper inlet path between adjacent trays. Yet, however, the angle of inclination of the prior art trays is limited by the tendency of incoming paper sheets to adversely affect the alignment of the trailing edges of the sheets with the back stop H'.

Figures 4A, 4B, 4C, 4D:
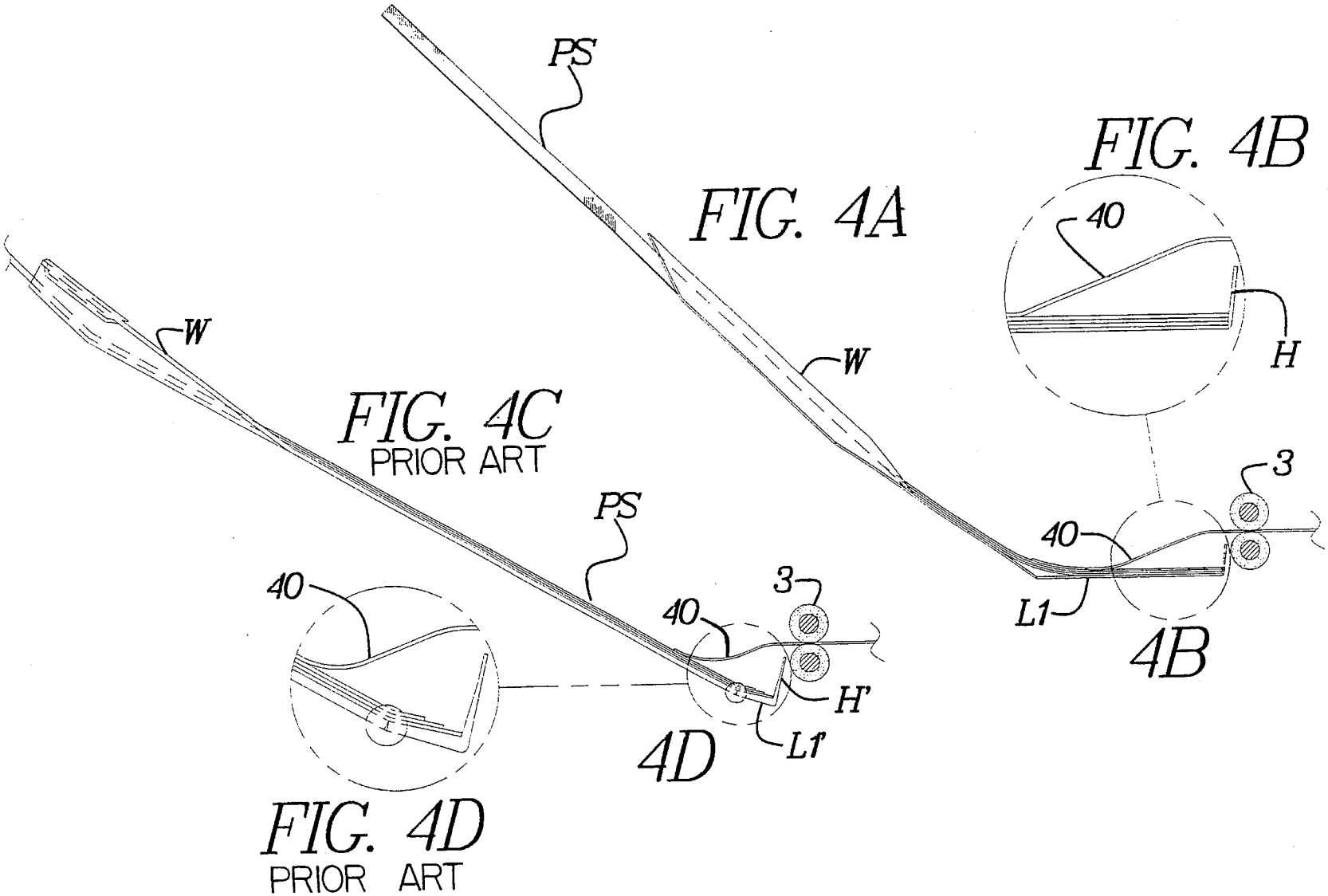
FIG. 4C PRIOR ART
FIG. 4D PRIOR ART
FIG. 4A is a view of the tray as in FIG. 3A, showing the feeding of sheets into the tray.
FIG. 4B is an enlarged view of the circled section of FIG. 4A.
FIG. 4C is a view corresponding with FIG. 4A, showing feeding of sheets into the prior art tray of FIG. 3B.
FIG. 4D is an enlarged view of the circled section of FIG. 4C.

Referring to FIGS. 4A and 4B it will be seen that in the case of the present invention, the leading end 40 of a sheet which is being fed into a tray via the sheet infeed 3 engages with the previous sheet deposited in the tray in the region of the horizontal tray section L1, so that there is a minimum of resistance of feeding of the incoming sheet along the horizontal portion of the previously deposited sheet. Therefore, there is a limited amount of interfacial friction tending to cause displacement of the previously deposited sheet from engagement of the back stop H. In addition, the fact that the tray sections L2 and L3 are disposed at a substantial angle from horizontal, the resistance of the previously deposited paper sheets PS to move upwardly due to drag friction imposed by the incoming sheet is enhanced.

On the other hand, as seen in FIG. 4C, the leading section of an incoming sheet 40 first impinges on the previously deposited sheet well downstream of the relatively short tray section L1' and due to the fact that the angle of inclination of the tray in FIG. 4C and 4D is significantly less than the angle of inclination of FIG. 4A, then it can be seen, and it has been found, that there is a tendency of the incoming sheet to move the previously deposited sheet longitudinally in the direction of sheet infeed and away from the back stop H'. This results in uneven alignment of the sheets against the back stop, so that in the case of a stapling sorter, as is well known in the prior art including U.S. Pat. No. 5,393,042, the trailing edges of the sheets are not properly aligned at the time of insertion of a staple.

For comparison, the paper sheet set shown in the tray of FIG. 3A and the paper sheet set in the prior art set of FIG. 3B are proportionally illustrated as representative of a sheet of 17 inches in length. Thus, in FIG. 3A the relative length of tray sections L1, L2 and L3 is approximately 289 mm and the ratio of the effective tray length to the length of the paper sheets PS is 0.67. By way of comparison, then, assuming the same paper length in the tray of FIG. 3B, the effective length of the tray, namely L1', L2' and L3' equals 355 mm, while the ratio of the effective tray length in FIG. 3B to the length of the paper sheets PS equals 0.82.

In terms of the material requirements for the production of the trays of FIGS. 3A and 3B, it can be determined from the above that the tray of FIG. 3A requires approximately 82% of the material required in the tray of FIG. 3B to support the paper sheets of a length of 17 inches.

While there have been shown and described what are presently considered to be the preferred embodiments of this invention, it will be obvious to those skilled in the art that various changes and modification may be made without departing from the broader aspects of this invention. It is, therefore, aimed in the appended claims to cover all such changes and modifications that fall within the true spirit and scope of this invention.

I claim:

1. In a sheet receiver including a plurality of sheet receiving trays, said trays being arranged in a vertical stack and extending horizontally with sections of each of the trays disposed at an angle upwardly inclined from a horizontal plane, and means for feeding sheets into said trays from a printing apparatus, said trays each including a horizontally extended section adjacent to said means for feeding, the improvement wherein said upwardly inclined sections include a first portion disposed at a first angle of about 35 degrees from a horizontal plane and extending upwardly from said horizontally extended section, a second section disposed at a second angle of about 45 degrees from a horizontal plane and extending further upwardly from said first section and having wing portions for forming a transverse bow longitudinally of sheets extending upwardly beyond said second angle section, said wing portions combined with the angle from horizontal of said first and second sections preventing drooping of the upwardly extending sheets, said trays having a combined length versus the length of the longest sheets received therein of 0.67.

2. In a sheet receiver as defined in claim 1, said horizontally extended sections being of length on the order of 29% of the total length of said trays.

3. In a sheet receiver as defined in claim 1, the junction between at least one said horizontally extending section and at least one said first upwardly inclined section being formed by straight tray portions forming an angle for arcuately bending the sheets at the lower portion of said at least one first upwardly inclined section.

* * * * *